US009675102B2

(12) United States Patent
Hunt et al.

(10) Patent No.: US 9,675,102 B2
(45) Date of Patent: Jun. 13, 2017

(54) SMOKELESS TOBACCO PRODUCT COMPRISING EFFERVESCENT COMPOSITION

(75) Inventors: Eric Taylor Hunt, Pfafftown, NC (US); Darrell Eugene Holton, Jr., Clemmons, NC (US); Frank Kelley St. Charles, Bowling Green, KY (US)

(73) Assignee: R. J. Reynolds Tobacco Company, Winston-Salem, NC (US)

( * ) Notice: Subject to any disclaimer, the term of this patent is extended or adjusted under 35 U.S.C. 154(b) by 975 days.

(21) Appl. No.: 12/876,785

(22) Filed: Sep. 7, 2010

(65) Prior Publication Data

US 2012/0055494 A1 Mar. 8, 2012

(51) Int. Cl.

| | |
|---|---|
| ***A24B 15/00*** | (2006.01) |
| ***A24B 15/28*** | (2006.01) |
| ***A24B 13/00*** | (2006.01) |
| ***A24B 15/42*** | (2006.01) |

(52) U.S. Cl.
CPC ..... *A24B 15/281* (2013.01); *A24B 13/00* (2013.01); *A24B 15/42* (2013.01)

(58) Field of Classification Search
CPC ..... A24B 13/00; A24B 15/42; A24B 15/281
USPC ..... 131/352
See application file for complete search history.

(56) References Cited

U.S. PATENT DOCUMENTS

| | | | | |
|---|---|---|---|---|
| 1,376,586 | A | 5/1921 | Schwartz | |
| 3,696,917 | A | 10/1972 | Levi | |
| 4,513,756 | A | 4/1985 | Pittman et al. | |
| 4,528,993 | A | 7/1985 | Sensabaugh, Jr. et al. | |
| 4,612,942 | A * | 9/1986 | Dobberstein et al. | 131/276 |
| 4,624,269 | A | 11/1986 | Story et al. | |
| 4,639,368 | A | 1/1987 | Niazi et al. | |
| 4,975,270 | A * | 12/1990 | Kehoe | 424/48 |
| 4,987,907 | A | 1/1991 | Townend | |
| 4,991,599 | A | 2/1991 | Tibbetts | |
| 5,092,352 | A | 3/1992 | Sprinkle, III et al. | |
| 5,178,878 | A | 1/1993 | Wehling et al. | |
| 5,223,264 | A * | 6/1993 | Wehling et al. | A61K 9/0007 424/44 |
| 5,387,416 | A | 2/1995 | White et al. | |
| 6,235,318 | B1 | 5/2001 | Lombardy, Jr. et al. | |
| 6,668,839 | B2 | 12/2003 | Williams | |
| 6,834,654 | B2 | 12/2004 | Williams | |
| 6,953,040 | B2 | 10/2005 | Atchley et al. | |
| 6,974,590 | B2 | 12/2005 | Pather et al. | |
| 7,032,601 | B2 | 4/2006 | Atchley et al. | |
| 7,381,667 | B2 | 6/2008 | Bergquist et al. | |
| 7,694,686 | B2 | 4/2010 | Atchley et al. | |
| 2004/0020503 | A1 | 2/2004 | Williams | |
| 2005/0008732 | A1* | 1/2005 | Gebreselassie et al. | 426/5 |
| 2005/0115580 | A1 | 6/2005 | Quinter et al. | |
| 2005/0244521 | A1 | 11/2005 | Strickland et al. | |
| 2006/0078508 | A1 | 4/2006 | Gebreselassie et al. | |
| 2006/0078509 | A1* | 4/2006 | Gebreselassie et al. | 424/48 |
| 2006/0191548 | A1* | 8/2006 | Strickland et al. | 131/347 |
| 2007/0062549 | A1 | 3/2007 | Holton, Jr. et al. | |
| 2007/0186941 | A1 | 8/2007 | Holton, Jr. et al. | |
| 2007/0186942 | A1 | 8/2007 | Strickland et al. | |
| 2008/0029110 | A1 | 2/2008 | Dube et al. | |
| 2008/0029116 | A1 | 2/2008 | Robinson et al. | |
| 2008/0029117 | A1 | 2/2008 | Mua et al. | |
| 2008/0173317 | A1 | 7/2008 | Robinson et al. | |
| 2008/0196730 | A1 | 8/2008 | Engstrom et al. | |
| 2008/0209586 | A1 | 8/2008 | Nielsen et al. | |
| 2008/0305216 | A1 | 12/2008 | Crawford et al. | |
| 2009/0025741 | A1 | 1/2009 | Crawford et al. | |
| 2009/0065013 | A1 | 3/2009 | Essen et al. | |
| 2009/0214442 | A1 | 8/2009 | Agarwal et al. | |
| 2009/0293889 | A1 | 12/2009 | Kumar et al. | |
| 2010/0018539 | A1 | 1/2010 | Brinkley et al. | |
| 2010/0170522 | A1 | 7/2010 | Sun et al. | |
| 2011/0014132 | A1* | 1/2011 | Liu | 424/43 |
| 2013/0206639 | A1* | 8/2013 | Johnson | 206/540 |

FOREIGN PATENT DOCUMENTS

| | | | |
|---|---|---|---|
| WO | WO 97/06786 | A1 | 2/1997 |
| WO | WO 2004/095959 | A1 | 11/2004 |
| WO | WO 2009/141321 | * | 11/2009 |
| WO | WO 2009/143845 | A2 | 12/2009 |

* cited by examiner

*Primary Examiner* — Michael H Wilson
*Assistant Examiner* — Dionne Walls Mayes
(74) *Attorney, Agent, or Firm* — Womble Carlyle Sandridge & Rice LLP

(57) ABSTRACT

The invention provides an smokeless tobacco composition adapted for oral use, the composition including a tobacco material and an effervescent material. The effervescent material includes an acid component and a base component, wherein the acid component includes a triprotic acid such as citric acid and at least one additional acid. The invention also provides a method for making a smokeless tobacco composition that involves first forming a granulation mixture, granulating the granulation mixture, and then blending the resulting granules with further blending components. Thereafter, the material can be formed into a predetermined shape, such as by compression or extrusion. The acid component of the effervescent material is divided into two portions, the first portion added to the granulation mixture and the remaining portion added during the blending step.

28 Claims, No Drawings

SMOKELESS TOBACCO PRODUCT COMPRISING EFFERVESCENT COMPOSITION

FIELD OF THE INVENTION

The present invention relates to products made or derived from tobacco, or that otherwise incorporate tobacco, and are intended for human consumption. In particular, the invention relates to compositions or formulations incorporating tobacco, and that are intended to be employed in a smokeless form.

BACKGROUND OF THE INVENTION

Cigarettes, cigars, and pipes are popular smoking articles that employ tobacco in various forms. Such smoking articles are employed by heating or burning tobacco to generate aerosol (e.g., smoke) that may be inhaled by the smoker. Tobacco may also be enjoyed in a so-called "smokeless" form. Particularly popular smokeless tobacco products are employed by inserting some form of processed tobacco or tobacco-containing formulation into the mouth of the user. See for example, the types of smokeless tobacco formulations, ingredients, and processing methodologies set forth in U.S. Pat. No. 1,376,586 to Schwartz; U.S. Pat. No. 3,696,917 to Levi; U.S. Pat. No. 4,513,756 to Pittman et al.; U.S. Pat. No. 4,528,993 to Sensabaugh, Jr. et al.; U.S. Pat. No. 4,624,269 to Story et al.; U.S. Pat. No. 4,991,599 to Tibbetts; U.S. Pat. No. 4,987,907 to Townsend; U.S. Pat. No. 5,092,352 to Sprinkle, III et al.; U.S. Pat. No. 5,387,416 to White et al.; U.S. Pat. No. 6,834,654 to Williams; U.S. Pat. No. 6,953,040 to Atchley et al.; U.S. Pat. No. 7,032,601 to Atchley et al.; and U.S. Pat. No. 7,694,686 to Atchley et al.; US Pat. Pub. Nos. 2002/0162562 to Williams; 2002/0162563 to Williams; 2003/0070687 to Atchley et al.; 2004/0020503 to Williams; 2005/0115580 to Quinter et al.; 2005/0178398 to Breslin et al.; 2005/0244521 to Strickland et al.; 2006/0191548 to Strickland et al.; 2007/0062549 to Holton, Jr. et al.; 2007/0186941 to Holton, Jr. et al.; 2007/0186942 to Strickland et al.; 2008/0029110 to Dube et al.; 2008/0029116 to Robinson et al.; 2008/0029117 to Mua et al.; 2008/0173317 to Robinson et al.; 2008/0196730 to Engstrom et al.; 2008/0209586 to Neilsen et al.; 2008/0305216 to Crawford et al.; 2009/0065013 to Essen et al.; and 2009/0293889 to Kumar et al.; PCT WO 04/095959 to Arnarp et al.; and U.S. patent application Ser. No. 12/638,394, filed Dec. 15, 2009, to Mua et al.; each of which is incorporated herein by reference. Exemplary smokeless tobacco products include CAMEL Snus, CAMEL Orbs, CAMEL Strips and CAMEL Sticks by R. J. Reynolds Tobacco Company; REVEL Mint Tobacco Packs and SKOAL Snus by U.S. Smokeless Tobacco Company; and MARLBORO Snus and Taboka by Philip Morris USA.

It would be desirable to provide an enjoyable form of a tobacco product, such as a smokeless tobacco product, and to provide processes for preparing tobacco-containing compositions suitable for use in smokeless tobacco products.

SUMMARY OF THE INVENTION

The present invention relates to a tobacco product, most preferably a smokeless tobacco product intended or configured for insertion into the mouth of a user, and to processes for preparing a formulation suitable for use within such a smokeless tobacco product. The present invention relates to tobacco products, and in particular, smokeless tobacco products, that incorporate materials from *Nicotiana* species (e.g., tobacco-derived materials) and an effervescent material. The effervescent material adds distinctive organoleptic properties to the smokeless tobacco product and also aids in disintegration of the tobacco product in the oral cavity. The invention identifies particularly advantageous acid and base materials for use as the effervescent materials in the smokeless tobacco products of the invention, as well as advantageous techniques for combining the effervescent materials during manufacturing.

In one aspect, the invention provides an effervescent smokeless tobacco composition adapted for oral use, the material comprising a tobacco material (e.g., in the form of a particulate material or as a tobacco extract) and an effervescent material comprising an acid component and a base component. The acid component typically includes a triprotic acid, such as a tricarboxylic acid, and at least one additional acid, such as a dicarboxylic acid. One acid combination suitable for use in the invention is a combination of citric acid and tartaric acid. The weight ratio of the two acids can vary, but is typically about 2:1 to about 1:2. Exemplary base materials for use in the effervescent material include carbonate materials, bicarbonate materials, or mixtures thereof. Other additives can be incorporated into the effervescent smokeless tobacco composition, such as salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof. The effervescent smokeless tobacco composition of the invention is typically compressed or extruded into a predetermined shape, such as a pellet, rod, or film.

In one embodiment, the effervescent smokeless tobacco composition comprises at least about 20 dry weight percent of tobacco material, based on the total weight of the composition; at least about 10 dry weight percent of effervescent material; at least about 0.1 dry weight percent of at least one sweetener; at least about 10 dry weight percent of at least one filler; at least about 0.5 dry weight percent of at least one binder; at least about 0.5 dry weight percent of at least one flavorant; and at least about 0.5 dry weight percent of at least one flow aid. Exemplary fillers include at least one of microcrystalline cellulose, mannitol, and maltodextrin. The smokeless tobacco composition of the invention can be packaged as a plurality of product units in a handheld smokeless tobacco container.

In certain embodiments, the smokeless tobacco composition further includes an outer coating, such as outer coating comprising a film-forming polymer, such as a cellulosic polymer, and an optional plasticizer. Other optional coating ingredients include flavorants, sweeteners, colorants, and salts.

In another aspect, the invention provides a method of making a smokeless tobacco composition, the method comprising: preparing a granulation mixture comprising a tobacco material, a first portion of an acid component, and optionally at least one additional additive (e.g., salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof); granulating the granulation mixture by mixing the granulation mixture with a binding solution to form a granular material; blending the granular material with a base component, a second portion of an acid component, and optionally at least one further additive (e.g., salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof) to form an effervescent smokeless tobacco composition; and forming the effervescent smokeless tobacco composition into a predetermined shape. The first portion of acid component typically comprises about 25 to about 75 dry weight percent of the total acid component within the smokeless tobacco composition, more often about 25 to about 50 dry weight percent. In addition to the acid component, the base component can also be divided between the granulation mixture and the final blending ingredients, meaning the granulation mixture can also contain at least one base component. The forming step will typically involve compressing or extruding the effervescent smokeless tobacco composition into the predetermined shape. Optionally, the method can further include applying an outer coating to the smokeless tobacco composition after the forming step.

In one embodiment, the granulation mixture comprises one or more additives selected from the group consisting of fillers, binders, sweeteners, colorants, and/or compressibility aids, and the additives used in the blending step include one or more flavorants and/or flow aids.

In yet another aspect, the invention provides a multi-layer product and a process for producing such a product, the multi-layer product comprising at least one effervescent layer and at least one non-effervescent layer. A method for making such a product using, for example, rotor granulation equipment can include the steps of:

(i) providing a core material having a substantially spherical shape (e.g., a compressible powder material, such as microcrystalline cellulose, salt or sugar, having a diameter of about 600 microns to about 3,000 microns);

(ii) applying a first powder coating material and a binder solution to the core material to form a first coating layer; and (iii) applying a second powder coating material and a binder solution to the first coating layer to form a second coating layer, wherein one of the first and second coating layers is non-effervescent and comprises a tobacco material (e.g., a coating composition comprising a tobacco material, one or more fillers, and at least one flavorant or sweetener) and the other of the first and second coating layers comprises an effervescent material (e.g., a coating composition comprising a carbonate material, a bicarbonate material, an acid component, one or more fillers, and optionally, a tobacco material).

The two powder coating materials will typically have a particle size in the range of about 10 to about 100 microns. The binder solution is typically an aqueous or alcohol-based solution containing a film-forming polymer such as povidone or hydroxypropylcellulose. The layering process can be repeated as desired by applying additional effervescent and non-effervescent layers in any order until the desired product size is reached.

DETAILED DESCRIPTION OF THE INVENTION

The present invention now will be described more fully hereinafter. This invention may, however, be embodied in many different forms and should not be construed as limited to the embodiments set forth herein; rather, these embodiments are provided so that this disclosure will be thorough and complete, and will fully convey the scope of the invention to those skilled in the art. As used in this specification and the claims, the singular forms "a," "an," and "the" include plural referents unless the context clearly dictates otherwise. Reference to "dry weight percent" or "dry weight basis" refers to weight on the basis of dry ingredients (i.e., all ingredients except water).

The invention provides a smokeless tobacco product suitable for insertion in the oral cavity that includes a tobacco material and an effervescent material. The effervescent material is a combination of two or more components capable of reacting, typically in an aqueous environment, to produce a gas. The resulting gas is typically carbon dioxide, although it is possible to use reactive couples that produce other gases that are safe for human consumption, such as oxygen. The presence of the effervescent materials aids disintegration of the smokeless tobacco product in the oral cavity, and also adds distinctive organoleptic properties to the product, particularly in terms of taste and mouthfeel. The use of effervescent materials is described, for example, in U.S. Pat. No. 4,639,368 to Niazi et al.; U.S. Pat. No. 5,178,878 to Wehling et al.; U.S. Pat. No. 5,223,264 to Wehling et al.; U.S. Pat. No. 6,974,590 to Pather et al.; and U.S. Pat. No. 7,381,667 to Bergquist et al., as well as US Pat. Pub. Nos. 2006/0191548 to Strickland et al.; 2009/0025741 to Crawford et al; 2010/0018539 to Brinkley et al.; and 2010/0170522 to Sun et al.; and PCT WO 97/06786 to Johnson et al., all of which are incorporated by reference herein.

In one embodiment, the effervescent material is a reactive couple comprising at least one acid (or anhydride or salt thereof) and at least one base capable of reacting to release carbon dioxide. Multiple acids and multiple bases can be combined in the same product to produce the desired reaction.

In certain embodiments, the acid component of the effervescent material is selected from carboxylic acids having about 2 to about 12 carbon atoms (e.g., C2-C10 or C2-C8 or C2-C6 carboxylic acids), wherein the carboxylic acids are monoprotic or polyprotic (e.g., dicarboxylic acids or tricarboxylic acids). Exemplary organic acids include citric acid, malic acid, tartaric acid, succinic acid, adipic acid, fumaric acid, and combinations thereof. Exemplary acid salts include sodium salts, calcium salts, dihydrogen phosphate salts, and disodium dihydrogen pyrophosphate salts.

In one embodiment, a combination of acids is utilized where at least one acid is a polyprotic acid, such as a dicarboxylic acid (tartaric acid) or a tricarboxylic acid (e.g., citric acid). Combinations of a dicarboxylic acid and a tricarboxylic acid are also suitable for use in the invention, such as a combination of tartaric acid and citric acid. Citric acid is a particularly useful acid component because it also imparts a certain cohesiveness or binding effect to the overall smokeless tobacco composition.

Exemplary bases include carbonate and bicarbonate materials, particularly alkali metal or alkaline earth metal salts thereof. Carbonate and bicarbonate base materials capable of use in the present invention include sodium carbonate, sodium bicarbonate, potassium carbonate, potassium bicarbonate, magnesium carbonate, calcium carbonate, sodium sesquicarbonate, sodium glycine carbonate, lysine carbonate, and arginine carbonate.

The amount of total effervescent material (i.e., all reactive materials that produce the gaseous product) in the product can vary. The amount of such material should be sufficient to enable the product to effervesce when placed in the oral cavity. The amount of effervescent material is typically about 5 to about 50 dry weight percent, often about 8 to about 30 dry weight percent, and most often about 10 to about 25 dry weight percent (e.g., about 10, about 12, about 14, about 16, about 18, about 20, or about 22 dry weight percent), based on the total weight of the smokeless tobacco composition. The amount of effervescent material in some embodiments can be characterized as at least about 10 dry weight percent, or at least about 15 dry weight percent, or at least about 20 dry weight percent, or at least about 25 dry weight percent. The amount of effervescent material in some embodiments can be characterized as no more than about 50 dry weight percent, no more than about 40 dry weight percent, no more than about 35 dry weight percent, or no more than about 30 dry weight percent.

In certain embodiments, it is desirable for the reaction between the acid and base component to proceed completely. To ensure this result, the relevant amount of acid and base can be adjusted so that the necessary equivalent amounts are present. For example, if a diprotic acid is used, then either a di-reactive base can be used in roughly equivalent amount or a mono-reactive base could be used at a level roughly twice that of the acid. Alternatively, an excess amount of either acid or base can be used, particularly where the acid or base is intended to provide an independent effect on the organoleptic properties of the smokeless tobacco composition beyond simply providing effervescence.

The amount of acid component of the effervescent material in the product can vary, but is typically about 1 to about 25 dry weight percent, often about 3 to about 20 dry weight percent, and most often about 5 to about 15 dry weight percent (e.g., about 6, about 7, about 8, about 9, about 10, about 11, or about 12 dry weight percent). In embodiments where a combination of two acids is utilized, each acid is typically present in a weight ratio of about 2:1 to about 1:2 (e.g., about 1.5:1 to about 1:1.5 or about 1:1). Where three or more acids are utilized, each acid is typically present in an amount of about 10 to about 35 dry weight percent based on the total weight of the acids.

The amount of the base component (e.g., carbonate or bicarbonate materials) of the effervescent material in the product can vary, but is typically about 4 to about 30 dry weight percent, often about 5 to about 25 dry weight percent, and most often about 8 to about 20 dry weight percent (e.g., about 8, about 10, about 12, about 14, about 16, about 18, or about 20 dry weight percent). In certain embodiments, the product of the invention will include both a carbonate component and a bicarbonate component. For such embodiments, the amount of carbonate material can vary, but is typically about 3 to about 20 dry weight percent, often about 5 to about 15 dry weight percent, and most often about 8 to about 15 dry weight percent (e.g., about 8, about 9, about 10, about 11, about 12, about 13, or about 14 dry weight percent). The amount of bicarbonate material can vary, but is typically about 3 to about 20 dry weight percent, often about 5 to about 15 dry weight percent, and most often about 8 to about 15 dry weight percent (e.g., about 8, about 9, about 10, about 11, about 12, about 13, or about 14 dry weight percent).

A combination of carbonate and bicarbonate components can be desirable because bicarbonate materials, while highly reactive in effervescent reactions, are not efficient buffering agents in the preferred product pH range. Thus, in certain embodiments utilizing both a bicarbonate and carbonate material, it is advantageous to stoichiometrically match the bicarbonate amount to the acid component of the effervescent material and use a carbonate material as the main buffering agent. In this manner, although the carbonate material would be expected to participate in the effervescent reaction to a limited degree, the bicarbonate material is present in an amount sufficient to fully react with the available acid component and the carbonate material is present in an amount sufficient to provide the desired pH range.

The products of the invention incorporate some form of a plant of the *Nicotiana* species, and most preferably, those compositions or products incorporate some form of tobacco. The selection of the *Nicotiana* species can vary; and in particular, the selection of the types of tobacco or tobaccos may vary. Tobaccos that can be employed include flue-cured or Virginia (e.g., K326), burley, sun-cured (e.g., Indian Kurnool and Oriental tobaccos, including Katerini, Prelip, Komotini, Xanthi and Yambol tobaccos), Maryland, dark, dark-fired, dark air cured (e.g., Passanda, Cubano, Jatin and Bezuki tobaccos), light air cured (e.g., North Wisconsin and Galpao tobaccos), Indian air cured, Red Russian and *Rustica* tobaccos, as well as various other rare or specialty tobaccos and various blends of any of the foregoing tobaccos. Descriptions of various types of tobaccos, growing practices and harvesting practices are set forth in *Tobacco Production, Chemistry and Technology*, Davis et al. (Eds.) (1999), which is incorporated herein by reference. Various representative other types of plants from the *Nicotiana* species are set forth in Goodspeed, *The Genus Nicotiana*, (*Chonica Botanica*) (1954); U.S. Pat. No. 4,660,577 to Sensabaugh, Jr. et al.; U.S. Pat. No. 5,387,416 to White et al. and U.S. Pat. No. 7,025,066 to Lawson et al.; US Patent Appl. Pub. Nos. 2006/0037623 to Lawrence, Jr. and 2008/0245377 to Marshall et al.; each of which is incorporated herein by reference. Exemplary *Nicotiana* species include *N. tabacum, N. rustica, N. alata, N. arentsii, N. excelsior, N. forgetiana, N. glauca, N. glutinosa, N. gossei, N. kawakamii, N. knightiana, N. langsdorffi, N. otophora, N. setchelli, N. sylvestris, N. tomentosa, N. tomentosiformis, N. undulata, N.×sanderae, N. africana, N. amplexicaulis, N. benavidesii, N. bonariensis, N. debneyi, N. longiflora, N. maritina, N. megalosiphon, N. occidentalis, N. paniculata, N. plumbaginifolia, N. raimondii, N. rosulata, N. simulans, N. stocktonii, N. suaveolens, N. umbratica, N. velutina, N. wigandioides, N. acaulis, N. acuminata, N. attenuata, N. benthamiana, N. cavicola, N. clevelandii, N. cordifolia, N. corymbosa, N. fragrans, N. goodspeedii, N. linearis, N. miersii, N. nudicaulis, N. obtusifolia, N. occidentalis* subsp. *Hersperis, N. pauciflora, N. petunioides, N. quadrivalvis, N. repanda, N. rotundifolia, N. solanifolia*, and *N. spegazzinii.*

*Nicotiana* species can be derived using genetic-modification or crossbreeding techniques (e.g., tobacco plants can be genetically engineered or crossbred to increase or decrease production of components, characteristics or attributes). See, for example, the types of genetic modifications of plants set forth in U.S. Pat. No. 5,539,093 to Fitzmaurice et al.; U.S. Pat. No. 5,668,295 to Wahab et al.; U.S. Pat. No. 5,705,624 to Fitzmaurice et al.; U.S. Pat. No. 5,844,119 to Weigl; U.S. Pat. No. 6,730,832 to Dominguez et al.; U.S. Pat. No. 7,173,170 to Liu et al.; U.S. Pat. No. 7,208,659 to Colliver et al. and U.S. Pat. No. 7,230,160 to Benning et al.; U.S. Patent Appl. Pub. No. 2006/0236434 to Conkling et al.; and PCT WO 2008/103935 to Nielsen et al.

For the preparation of smokeless and smokable tobacco products, it is typical for harvested plant of the *Nicotiana* species to be subjected to a curing process. Descriptions of various types of curing processes for various types of tobaccos are set forth in *Tobacco Production, Chemistry and Technology*, Davis et al. (Eds.) (1999). Exemplary techniques and conditions for curing flue-cured tobacco are set forth in Nestor et al., *Beitrage Tabakforsch. Int.,* 20, 467-475 (2003) and U.S. Pat. No. 6,895,974 to Peele, which are incorporated herein by reference. Representative techniques and conditions for air curing tobacco are set forth in U.S. Pat. No. 7,650,892 to Groves et al.; Roton et al., *Beitrage Tabakforsch. Int.,* 21, 305-320 (2005) and Staaf et al., *Beitrage Tabakforsch. Int.,* 21, 321-330 (2005), which are incorporated herein by reference. Certain types of tobaccos can be subjected to alternative types of curing processes, such as fire curing or sun curing. Preferably, harvested tobaccos that are cured are then aged. As such, tobaccos used for the preparation of tobacco compositions or products most preferably incorporate components of tobaccos that have been cured and aged.

At least a portion of the plant of the *Nicotiana* species (e.g., at least a portion of the tobacco portion) can be employed in an immature form. That is, the plant, or at least one portion of that plant, can be harvested before reaching a stage normally regarded as ripe or mature. As such, for example, tobacco can be harvested when the tobacco plant is at the point of a sprout, is commencing leaf formation, is commencing flowering, or the like.

At least a portion of the plant of the *Nicotiana* species (e.g., at least a portion of the tobacco portion) can be employed in a mature form. That is, the plant, or at least one portion of that plant, can be harvested when that plant (or plant portion) reaches a point that is traditionally viewed as being ripe, over-ripe or mature. As such, for example, through the use of tobacco harvesting techniques conventionally employed by farmers, Oriental tobacco plants can be harvested, burley tobacco plants can be harvested, or Virginia tobacco leaves can be harvested or primed by stalk position.

After harvest, the plant of the *Nicotiana* species, or portion thereof, can be used in a green form (e.g., tobacco can be used without being subjected to any curing process). For example, tobacco in green form can be frozen, subjected to irradiation, yellowed, dried, cooked (e.g., roasted, fried or boiled), or otherwise subjected to storage or treatment for later use. Such tobacco also can be subjected to aging conditions.

The tobacco material is typically used in a form that can be described as shredded, ground, granulated, fine particulate, or powder form. The manner by which the tobacco material is provided in a finely divided or powder type of form may vary. Preferably, plant parts or pieces are comminuted, ground or pulverized into a particulate form using equipment and techniques for grinding, milling, or the like. Most preferably, the plant material is relatively dry in form during grinding or milling, using equipment such as hammer mills, cutter heads, air control mills, or the like. The tobacco material typically has an average particle size of about 10 to about 100 microns, more often about 20 to about 75 microns, and most often about 25 to about 50 microns.

At least a portion of the tobacco material employed in the tobacco composition or product can have the form of an extract. Tobacco extracts can be obtained by extracting tobacco using a solvent having an aqueous character such as distilled water or tap water. As such, aqueous tobacco extracts can be provided by extracting tobacco with water, such that water insoluble pulp material is separated from the aqueous solvent and the water soluble and dispersible tobacco components dissolved and dispersed therein. The tobacco extract can be employed in a variety of forms. For example, the aqueous tobacco extract can be isolated in an essentially solvent free form, such as can be obtained as a result of the use of a spray drying or freeze drying process, or other similar types of processing steps. Alternatively, the aqueous tobacco extract can be employed in a liquid form, and as such, the content of tobacco solubles within the liquid solvent can be controlled by selection of the amount of solvent employed for extraction, concentration of the liquid tobacco extract by removal of solvent, addition of solvent to dilute the liquid tobacco extract, or the like. Exemplary techniques for extracting components of tobacco are described in U.S. Pat. No. 4,144,895 to Fiore; U.S. Pat. No. 4,150,677 to Osborne, Jr. et al.; U.S. Pat. No. 4,267,847 to Reid; U.S. Pat. No. 4,289,147 to Wildman et al.; U.S. Pat. No. 4,351,346 to Brummer et al.; U.S. Pat. No. 4,359,059 to Brummer et al.; U.S. Pat. No. 4,506,682 to Muller; U.S. Pat. No. 4,589,428 to Keritsis; U.S. Pat. No. 4,605,016 to Soga et al.; U.S. Pat. No. 4,716,911 to Poulose et al.; U.S. Pat. No. 4,727,889 to Niven, Jr. et al.; U.S. Pat. No. 4,887,618 to Bernasek et al.; U.S. Pat. No. 4,941,484 to Clapp et al.; U.S. Pat. No. 4,967,771 to Fagg et al.; U.S. Pat. No. 4,986,286 to Roberts et al.; U.S. Pat. No. 5,005,593 to Fagg et al.; U.S. Pat. No. 5,018,540 to Grubbs et al.; U.S. Pat. No. 5,060,669 to White et al.; U.S. Pat. No. 5,065,775 to Fagg; U.S. Pat. No. 5,074,319 to White et al.; U.S. Pat. No. 5,099,862 to White et al.; U.S. Pat. No. 5,121,757 to White et al.; U.S. Pat. No. 5,131,414 to Fagg; U.S. Pat. No. 5,131,415 to Munoz et al.; U.S. Pat. No. 5,148,819 to Fagg; U.S. Pat. No. 5,197,494 to Kramer; U.S. Pat. No. 5,230,354 to Smith et al.; U.S. Pat. No. 5,234,008 to Fagg; U.S. Pat. No. 5,243,999 to Smith; U.S. Pat. No. 5,301,694 to Raymond et al.; U.S. Pat. No. 5,318,050 to Gonzalez-Parra et al.; U.S. Pat. No. 5,343,879 to Teague; U.S. Pat. No. 5,360,022 to Newton; U.S. Pat. No. 5,435,325 to Clapp et al.; U.S. Pat. No. 5,445,169 to Brinkley et al.; U.S. Pat. No. 6,131,584 to Lauterbach; U.S. Pat. No. 6,298,859 to Kierulff et al.; U.S. Pat. No. 6,772,767 to Mua et al.; and U.S. Pat. No. 7,337,782 to Thompson, all of which are incorporated by reference herein.

The tobacco material can be subjected to a pasteurization treatment or other suitable heat treatment process steps. Typical pasteurization process conditions involve subjecting the tobacco material, which most preferably is in moist form, to heat treatment. The heat treatment can be carried out in an enclosed vessel (e.g., one providing for a controlled atmospheric environment, controlled atmospheric components, and a controlled atmospheric pressure), or in a vessel that is essentially open to ambient air. The heat treatment, which is provided by subjecting the tobacco material to a sufficiently high temperature for a sufficient length of time, has the ability to alter the overall character or nature of the combined material to a desired degree. For example, the heat treatment can be used to provide a desired color or visual character to the tobacco material, desired sensory properties to the tobacco material, or a desired physical nature or texture to the tobacco material. In addition, the heat treatment causes the tobacco material to experience a treatment characteristic of a pasteurization type of treatment. As such, certain types and amounts of spores, mold, microbes, bacteria, and the like can be rendered inactive, or the enzymes generated thereby can be denatured or otherwise rendered inactive. Certain components that are rendered inactive, or are otherwise effectively reduced in number, are biological agents (e.g., enzymes) that have the capability of promoting formation of tobacco-specific nitrosamines. Pasteurization techniques are set forth, for example, on the websites of the U.S. Food and Drug Administration and the U.S. Department of Agriculture. Exemplary types of pasteurization equipment, methodologies and process conditions also are set forth in US Pat. Pub. Nos. 2009/0025738 to Mua et al.

and 2009/0025739 to Brinkley et al., which are incorporated by reference herein. If desired, the tobacco material can be subjected to irradiation sufficient to provide the benefits of pasteurization treatment.

In one embodiment, a moist tobacco material is subjected to a heat treatment (e.g., heating the moist tobacco material at a temperature of at least about 100° C.) after mixing the tobacco material with one or more additives selected from the group consisting of lysine, glycine, histidine, alanine, methionine, glutamic acid, aspartic acid, proline, phenylalanine, valine, arginine, compositions incorporating di- and trivalent cations, asparaginase, certain non-reducing saccharides, certain reducing agents, phenolic compounds, certain compounds having at least one free thiol group or functionality, oxidizing agents, oxidation catalysts, natural plant extracts (e.g., rosemary extract), and combinations thereof. Such a heat treatment process is described in U.S. application Ser. No. 12/476,621, filed Jun. 2, 2009, to Chen et al., which is incorporated by reference herein.

The amount of tobacco material in the smokeless tobacco product can vary, but tobacco material is typically the predominate ingredient. Exemplary weight ranges include about 10 to about 80 dry weight percent, often about 20 to about 60 dry weight percent, more often about 25 to about 40 dry weight percent. The amount of tobacco material in some embodiments can be characterized as at least about 10 dry weight percent, or at least about 20 dry weight percent, or at least about 25 dry weight percent, or at least about 30 dry weight percent. The amount of tobacco material in some embodiments can be characterized as no more than about 80 dry weight percent, no more than about 60 dry weight percent, no more than about 50 dry weight percent, or no more than about 40 dry weight percent.

Further additives can be admixed with, or otherwise incorporated within, the tobacco material and effervescent material mixture that forms the basis of the smokeless tobacco composition or formulation of the present invention. The additives can be artificial, or can be obtained or derived from herbal or biological sources. Exemplary types of additives include salts (e.g., sodium chloride, potassium chloride, sodium citrate, potassium citrate, sodium acetate, potassium acetate, and the like), natural sweeteners (e.g., fructose, sucrose, glucose, maltose, vanillin, ethylvanillin glucoside, mannose, galactose, lactose, and the like), artificial sweeteners (e.g., sucralose, saccharin, aspartame, acesulfame K, neotame and the like), organic and inorganic fillers (e.g., grains, processed grains, puffed grains, maltodextrin, dextrose, calcium carbonate, calcium phosphate, corn starch, lactose, sugar alcohols such as isomalt, mannitol, erythritol, xylitol, or sorbitol, finely divided cellulose, CARBOPOL® polymers, and the like), binders (e.g., povidone, sodium carboxymethylcellulose and other modified cellulosic types of binders, sodium alginate, xanthan gum, starch-based binders, gum arabic, lecithin, and the like), pH adjusters or buffering agents (e.g., metal hydroxides, preferably alkali metal hydroxides such as sodium hydroxide and potassium hydroxide, and other alkali metal buffers such as metal carbonates, preferably potassium carbonate or sodium carbonate, or metal bicarbonates such as sodium bicarbonate, and the like), colorants (e.g., dyes and pigments, including caramel coloring, titanium dioxide, and the like), humectants (e.g., glycerin, propylene glycol, and the like), oral care additives (e.g., thyme oil, eucalyptus oil, and zinc), preservatives (e.g., potassium sorbate and the like), syrups (e.g., honey, high fructose corn syrup, and the like), disintegration or compressibility aids (e.g., microcrystalline cellulose, croscarmellose sodium, crospovidone, sodium starch glycolate, pregelatinized corn starch, and the like), flavorant and flavoring mixtures, lipids such as meltable fats or oils, antioxidants, and mixtures thereof. If desired, the additive can be encapsulated as set forth in US Pat. Pub. No. 2008/0029110 to Dube et al, which is incorporated by reference herein.

The aforementioned types of additives can be employed together (e.g., as additive formulations) or separately (e.g., individual additive components can be added at different stages involved in the preparation of the final tobacco product). The relative amounts of the various components within the smokeless tobacco formulation may vary, and typically are selected so as to provide the desired sensory and performance characteristics to the tobacco product.

Representative buffers include metal carbonates, metal bicarbonates, and mixtures thereof. As noted herein, carbonate and bicarbonate materials are also useful in the compositions of the invention as part of the effervescent material. If desired for use as a buffer or pH adjuster, supplemental amounts of such materials can be used above the amount needed to provide the desired level of effervescence. A representative buffer can be composed of virtually all sodium carbonate, and another representative buffer can be composed of virtually all sodium bicarbonate. In certain embodiments, the buffer or pH adjusting ingredient is present in an amount of about 1 to about 15 dry weight percent, often about 5 to about 12 dry weight percent, and more often about 6 to about 10 dry weight percent.

As used herein, a "flavorant" or "flavoring agent" is any flavorful or aromatic substance capable of altering the sensory characteristics associated with the smokeless tobacco composition. Exemplary sensory characteristics that can be modified by the flavorant include, taste, mouthfeel, moistness, coolness/heat, and/or fragrance/aroma. The flavorants can be natural or synthetic, and the character of these flavors can be described as, without limitation, fresh, sweet, herbal, confectionary, floral, fruity or spice. Specific types of flavors include, but are not limited to, vanilla, coffee, chocolate, cream, mint, spearmint, menthol, peppermint, wintergreen, lavender, cardamon, nutmeg, cinnamon, clove, cascarilla, sandalwood, honey, jasmine, ginger, anise, sage, licorice, lemon, orange, apple, peach, lime, cherry, and strawberry. Flavorants utilized in the invention also can include components that are considered moistening, cooling or smoothening agents, such as eucalyptus. These flavors may be provided neat (i.e., alone) or in a composite (e.g., spearmint and menthol or orange and cinnamon). Flavorants are typically present in an amount of about 0.5 to about 10 dry weight percent, often about 1 to about 6 dry weight percent, and most often about 2 to about 5 dry weight percent.

Sweeteners can be used in natural or artificial form or as a combination of artificial and natural sweeteners. In one embodiment, sucralose is a primary sweetener ingredient. The amount of sweetener is typically about 0.1 to about 10 dry weight percent, often about 0.5 to about 6 dry weight percent, and most often about 1 to about 4 dry weight percent.

A colorant or colorant mixture, when present, is present in an amount necessary to achieve the desired coloring of the final product. The amount of colorant is typically about 0.1 to about 10 dry weight percent, often about 0.5 to about 5 dry weight percent, and most often about 1 to about 4 dry weight percent.

The smokeless tobacco compositions of the invention will typically include at least one filler ingredient. Such components of the composition often fulfill multiple functions, such as enhancing certain organoleptic properties such as texture and mouthfeel, enhancing cohesiveness or compressibility of the product, and the like. Certain embodiments of the invention utilize combinations of filler components such as a mixture of microcrystalline cellulose, mannitol, and maltodextrin. When present, the one or more fillers are typically present in an amount of about 5 to about 60 dry weight percent, often about 10 to about 35 dry weight percent, and most often about 20 to about 30 dry weight percent.

A binder component, such as povidone, can also be added to the formulation to enhance the cohesiveness of the overall formulation. Binder components can be added as a solid particulate or dissolved in a solvent. When present, a binder is typically present in an amount of about 0.5 to about 15 dry weight percent, often about 1 to about 10 dry weight percent, and most often about 2 to about 8 dry weight percent.

If necessary for downstream processing of the smokeless tobacco product, such as granulation or mixing, a flow aid can also be added to the material in order to enhance flowability of the smokeless tobacco material. Exemplary flow aids include microcrystalline cellulose, polyethylene glycol, stearic acid, calcium stearate, magnesium stearate, zinc stearate, canauba wax, and combinations thereof. When present, a representative amount of flow aid may make up at least about 0.5 percent or at least about 1 percent, of the total dry weight of the formulation. Preferably, the amount of flow aid within the formulation will not exceed about 5 percent, and frequently will not exceed about 3 percent, of the total dry weight of the formulation.

The manner by which the various components of the smokeless tobacco product are combined may vary. The various components of the product can be contacted, combined, or mixed together in conical-type blenders, mixing drums, ribbon blenders, or the like. As such, the overall mixture of various components may be relatively uniform in nature. See also, for example, the types of methodologies set forth in US Pat. Pub. Nos. 2005/0244521 to Strickland et al. and 2009/0293889 to Kumar et al.; each of which is incorporated herein by reference.

The smokeless tobacco products of the invention can be formed into a variety of shapes, including pills, tablets, spheres, strips, films, sheets, coins, cubes, beads, ovoids, obloids, cylinders, bean-shaped, sticks, or rods. Cross-sectional shape of the products can vary, and exemplary cross-sectional shapes include circles, squares, ovals, rectangles, and the like. Such product shapes can be formed in a variety of manners using equipment such as moving belts, nips, extruders, granulation devices, compaction devices, and the like.

Exemplary smokeless tobacco product forms of the invention include pelletized tobacco products (e.g., compressed or molded pellets produced from powdered or processed tobacco, such as those formed into a desired shape), extruded or cast pieces of tobacco (e.g., as strips, films or sheets, including multilayered films formed into a desired shape), products incorporating tobacco carried by a solid substrate (e.g., where substrate materials range from edible grains to inedible cellulosic sticks), extruded or formed tobacco-containing rods or sticks, tobacco-containing capsule-like materials having an outer shell region and an inner core region, straw-like (e.g., hollow formed) tobacco-containing shapes, sachets or packets containing tobacco (e.g., snus-like products), pieces of tobacco-containing gum, rolls of tape-like films, readily water-dissolvable or water-dispersible films or strips (see, for example, US Pat. Pub. No. 2006/0198873 to Chan et al.), or capsule-like materials possessing an outer shell (e.g., a pliable or hard outer shell that can be clear, colorless, translucent or highly colored in nature) and an inner region possessing tobacco or tobacco flavor (e.g., a Newtoniam fluid or a thixotropic fluid incorporating tobacco of some form), and the like.

Shapes such as rods and cubes can be formed by first extruding the material through a die having the desired cross-section (e.g., round or square) and then optionally cutting the extruded material into desired lengths. Exemplary extrusion equipment suitable for use in the invention include industrial pasta extruders such as Model TP 200/300 available from Emiliomiti, LLC of Italy. Sheet-like materials can be prepared by applying the tobacco composition onto a moving belt and passing the moving belt through a nip formed by opposing rollers, followed by cutting the sheet into desired lengths.

In certain preferred embodiments, the smokeless tobacco product is in the form of a compressed or molded pellet, wherein the pellet can have any of a variety of shapes including traditional pill or tablet shapes. Exemplary pellet sizes include pellets having a length and width in the range of about 3 mm to about 20 mm, more typically about 5 to about 12 mm. Exemplary pellet weights range from about 250 mg to about 600 mg, more typically about 300 mg to about 450 mg. Compressed smokeless tobacco pellets can be produced by compacting granulated tobacco and associated formulation components in the form of a pellet, and optionally coating each pellet with an overcoat material. Exemplary granulation devices are available as the FL-M Series granulator equipment (e.g., FL-M-3) from Vector Corporation and as WP 120V and WP 200VN from Alexanderwerk, Inc. Exemplary compaction devices, such as compaction presses, are available as Colton 2216 and Colton 2247 from Vector Corporation and as 1200i, 2200i, 3200, 2090, 3090 and 4090 from Fette Compacting. Devices for providing outer coating layers to compacted pelletized tobacco formulations are available as CompuLab 24, CompuLab 36, Accela-Cota 48 and Accela-Cota 60 from Thomas Engineering.

In one embodiment, the process for making the compressed pellet involves first forming a tobacco-containing granulation mixture, granulating the mixture by addition of a binder solution to produce an intermediate granular product, and then blending the granules with a second composition to form the final pellet composition. The final pellet composition is then compressed into pellet form and optionally coated. The tobacco-containing granulation mixture typically includes a tobacco material, a first portion of the acid component of the effervescent material (e.g., a first portion of a mixture of citric acid and tartaric acid), optionally a first portion of the base component of the effervescent material (e.g., a carbonate material), and optionally one or more binders, fillers, sweeteners, flavorants, colorants, compressibility aids, or other additives. If a base component is added to the granulation mixture, it is advantageous to use only a carbonate material (as opposed to a bicarbonate) to reduce the reactivity of the base component with the acid component. It is desirable to maintain the composition in a relatively inert state during manufacture so that the effervescing effect is preserved in the final product. Bicarbonate base materials are more reactive with an acid to create effervescence in the presence of moisture and therefore can lead to premature reactivity in the product. The granulation mixture is typically relatively dry, meaning no liquid ingredients are introduced and instead the mixture contains essentially all dry powder ingredients. The granulation material is mixed with a binder solution (e.g., by spraying the binder solution into the granulator) and granulated to a desired particle size, such as about 100 to about 200 microns. As would be understood in the art, the binder solution facilitates agglomeration of the dry powder granulation mixture into larger granules.

The binder solution used in the granulation process can be any aqueous or alcohol-based solution containing a binding agent, particularly a polymeric binding agent such as povidone or hydroxypropylcellulose, and can contain other additives including any of the additives discussed herein such as mannitol, maltodextrin, tobacco material, sweeteners, flavorants, and effervescent materials. The binder solution will typically have a solids content of about 5 to about 20 percent (w/w), and preferred solvents include water and ethanol. The binder solution used in the granulation process can be aqueous in nature without causing significant premature effervescence within the granulation mixture. Although not bound by any particular theory, the ability to use an aqueous solution at this stage in the process without detrimental results may be related to the use of only carbonate materials as the base component in the granulation mixture. Although carbonate materials will react with an acid material in the presence of water to provide effervescence, carbonate materials are not as reactive as bicarbonate materials.

Following granulation, the granules are advantageously dried, typically to a moisture level of less than about 7.0 weight percent, more typically less than about 6.5 weight percent, and often less than about 6.0 weight percent (e.g., a range of about 4.0 to about 7.0 weight percent). An exemplary moisture level is about 5.5 weight percent.

The dried granules are then blended with the remaining desired components of the smokeless tobacco product including a second portion of the acid component of the effervescent material (e.g., a second portion of a mixture of citric acid and tartaric acid), a base component of the effervescent material (e.g., a bicarbonate material), and optionally one or more binders, fillers, sweeteners, flavorants, colorants, flow aids, or other additives. The blending of the granulated material with the remaining ingredients can be accomplished using a granulator or any other mixing device. The final blended material is then compressed using conventional tableting techniques.

Splitting the acid component of the effervescent material into two portions has been found to beneficially affect the properties of the product. Although not bound by any particular theory of operation, incorporating at least a portion of the acid component into the granulation mix is believed to impart increased stability to the mix during the agglomeration/granulation process. The presence of the acid in the granulation mix is also believed to enhance sensory characteristics of the final product, most likely due to better dispersion of acid in the final product and limiting initial acidic taste.

In another aspect, the invention provides pellets formed using a rotor granulator wherein dry powder layers are accumulated on a substantially spherical core material to form roughly spherical pellet products. The core material can vary, but typically comprises a compressible powder material such as microcrystalline cellulose, sugar, or salt. The core material can also incorporate tobacco material if desired. The diameter of the core material is typically between about 600 microns and about 3,000 microns. Large core sizes can be advantageous because layering efficiency increases with increases in core size. Commercially available microcrystalline cellulose having a size in the range of about 700 to about 900 microns is one exemplary core material. In another example, an extruded tobacco product in the size range of about 2 to about 3 mm is used as the core material. The extruded tobacco product can be a product similar to the commercially available CAMEL Orbs product by R. J. Reynolds Tobacco Company.

The core material is charged to a rotor granulator, such as GXR-35 GRANUREX® Rotor Processor available from Vector Corporation, and a desired powder coating material and accompanying binder solution can be applied to the core material, thereby building up additional layers on the core and increasing the size of the spherical pellet. The powder coating material will typically include a tobacco material as the predominate ingredient, along with other dry powder components including any of the additives noted herein such as salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof. Mannitol, maltodextrin, sucralose, and microcrystalline cellulose are exemplary additives that can be admixed with a tobacco material. The particle size of the powder material used in the rotor granulation process can vary, but efficiency of the layering process increases with decreasing particle size. An exemplary particle size range is about 10 to about 100 microns.

Exemplary binder solutions for the rotor granulation process include aqueous or alcohol-based solutions of polymer binding agents including povidone and hydroxypropylcellulose, and can contain other additives including any of the additives discussed herein such as mannitol, maltodextrin, tobacco material, sweeteners, flavorants, and effervescent materials. The binder solution will typically have a solids content of about 5 to about 20 percent (w/w), and preferred solvents include water and ethanol. Ethanol or other alcohol solvents are advantageous in some embodiments because the use of non-aqueous solvents can reduce the moisture level in the pellet, which can reduce the drying time required to prepare the final product.

One advantage associated with rotor granulation is the ability to create a product having multiple concentric layers of different composition by simply changing the composition of the powder coating material and/or the binder solution at predetermined points during the process. In the context of effervescent products of the type described herein, rotor granulation allows the user to build a layered product where only certain predetermined layers include the effervescent material. For example, a multi-layer product might contain one or more layers of non-effervescent tobacco-containing composition and one or more layers of a composition containing an effervescent material, where the two types of layers are present in any desired order. The product may include a core surrounded by a tobacco-containing, non-effervescent layer followed by an outer layer containing an effervescent material. In addition, the production process could successively build concentric effervescent and non-effervescent layers repeatedly until the desired product size is reached. In this manner, a multi-layer product having a unique sensory profile can be created where effervescence occurs multiple times during use as outer layers dissolve in the oral cavity and expose additional effervescent material. The number of layers can vary, but rotor granulation products typically include a core surrounded by 1 to about 20 layers, more often about 2 to about 10 layers.

In one embodiment of a rotor granulation process, a non-effervescent powder coating material is prepared comprising a tobacco material and one or more additives, such as fillers, binders, flavorants, or the like. An exemplary non-effervescent powder coating material comprises at least about 30 dry weight percent of a tobacco material, at least about 30 dry weight percent of one or more fillers (e.g., mannitol, maltodextrin, microcrystalline cellulose, or mixtures thereof), and at least about 1 dry weight percent of one or more flavorants and/or one or more sweeteners (e.g., sucralose). The filler component of the non-effervescent material often has a total dry weight percentage as high as about 65 percent, and is typically in the form of a mixture, such as a mixture of about at least about 20 dry weight percent of mannitol, at least about 10 dry weight percent of maltodextrin, and at least about 20 dry weight percent of microcrystalline cellulose.

An effervescent powder coating material is also prepared comprising an effervescent material (e.g., a combination of sodium carbonate, sodium bicarbonate and citric acid) and one or more additives, such as one or more fillers, tobacco material, flavorants or sweeteners. An exemplary effervescent powder coating material comprises at least about 50 dry weight percent of carbonate/bicarbonate material (e.g., a mixture of sodium carbonate and sodium bicarbonate), at least about 15 dry weight percent of an acid component (e.g., citric acid), and at least about 20 weight percent of one or more fillers (e.g., mannitol, maltodextrin, microcrystalline cellulose, or mixtures thereof). In another embodiment, an effervescent powder coating material comprises at least about 40 dry weight percent of carbonate/bicarbonate material, at least about 10 dry weight percent of an acid component, at least about 15 dry weight percent of one or more fillers (e.g., mannitol), at least about 15 dry weight percent of tobacco material, and at least about 1 dry weight percent of one or more flavorants and/or one or more sweeteners (e.g., sucralose).

The effervescent and non-effervescent layers are concentrically layered in any order on a core material using a rotor granulation process and coating materials such as those described in Example 2 or in US Pat. Pub. No. 2010/0170522 to Sun et al., which is incorporated by reference herein. For example, the core material can have a first layer of the non-effervescent material followed by an overlying layer of the effervescent material. If desired, a barrier layer (e.g., a layer consisting solely of binder solution) can be sprayed on the pellet between each effervescent and non-effervescent layer and dried in order to reduce interaction between the effervescent material and moisture that may be present in the non-effervescent layers.

Other methods of preparing multi-layered products could also be used. For example, a conventional tablet press could be used to manufacture a layered product by simply adding multiple distinct granular compositions to the tablet press. In one embodiment, a multi-layer tablet or pellet is formed by adding a granular mixture comprising a first composition to the tablet press mold followed by addition of a granular mixture containing a second composition different from the first. This process could be repeated until the desired number of layers is reached. Thereafter, applying pressure to the tablet press mold will result in a pellet or tablet product with multiple, distinct layers. Multi-layered products made using this process could possess the same characteristics as described above in connection with rotor granulation systems. For instance, the pressed pellet could contain multiple effervescent and non-effervescent layers.

In yet another embodiment, a layered product could be created using a "pellet-in-pellet" approach where a first pellet containing a first composition is compressed and formed using a tablet press and then modified by addition of distinct outer layers. The outer layers can be added by introducing a granular mixture of desired composition into the tablet press mold on each side of a pre-formed pellet that is also introduced to the mold. The tablet press can be used to compress the granular mixtures onto the pre-formed pellet to create a layered structure.

As noted above, the smokeless tobacco products can include an optional outer coating, which can help to improve storage stability of the smokeless tobacco products of the invention as well as improve the packaging process by reducing friability and dusting.

The coating typically comprises a film-forming polymer, such as a cellulosic polymer, an optional plasticizer, and optional flavorants, colorants, salts, sweeteners or other additives of the types set forth herein. The coating compositions are usually aqueous in nature and can be applied using any pellet or tablet coating technique known in the art, such as pan coating. Exemplary film-forming polymers include cellulosic polymers such as methylcellulose, hydroxypropyl cellulose (HPC), hydroxypropyl methylcellulose (HPMC), hydroxyethyl cellulose, and carboxy methylcellulose. Exemplary plasticizers include aqueous solutions or emulsions of glyceryl monostearate and triethyl citrate.

In one embodiment, the coating composition comprises up to about 75 weight percent of a film-forming polymer solution (e.g., about 40 to about 70 weight percent based on total weight of the coating formulation), up to about 5 weight percent of a plasticizer (e.g., about 0.5 to about 2 weight percent), up to about 5 weight percent of a sweetener (e.g., about 0.5 to about 2 weight percent), up to about 10 weight percent of one or more colorants (e.g., about 1 to about 5 weight percent), up to about 5 weight percent of one or more flavorants (e.g., about 0.5 to about 3 weight percent), up to about 2 weight percent of a salt such as NaCl (e.g., about 0.1 to about 1 weight percent), and the balance water.

To prevent premature reaction of the effervescent materials in the pellet, the rate at which the aqueous coating composition is applied to the pellet can be controlled. For example, in one embodiment, the rate at which the coating material is applied to the pellets in a pan coater is maintained at a rate less than about 55 g of coating composition/min, more typically less than about 50 g/min, for a 25 lb batch of pellets.

Following coating, the smokeless product can be dried to a final desired moisture level. The moisture content of the smokeless tobacco product prior to use by a consumer can vary. Typically, the moisture content of the smokeless tobacco product, as present within a single unit of product prior to insertion into the mouth of the user, is within the rang of about 2 to about 6 weight percent (e.g., about 4 percent) based on the total weight of the product unit. Control of the final moisture of the product can be important for storage stability.

The manner by which the moisture content of the tobacco product is controlled may vary. For example, the tobacco product can be subjected to thermal or convection heating. As a specific example, the formulation may be oven-dried, in warmed air at temperatures of about 40° C. to about 95° C., with a preferred temperature range of about 60° C. to about 80° C., for a length of time appropriate to attain the desired moisture content. Alternatively, tobacco formulations may be moistened using casing drums, conditioning cylinders or drums, liquid spray apparatus, ribbon blenders, mixers available as FKM130, FKM600, FKM1200, FKM2000 and FKM3000 from Littleford Day, Inc., Plough Share types of mixer cylinders, and the like.

The acidity or alkalinity of the smokeless tobacco product, which is often characterized in terms of pH, can vary. Typically, the pH of that formulation is at least about 6.5, and preferably at least about 7.5. Typically, the pH of that formulation will not exceed about 9.5, and often will not exceed about 9.0. A representative tobacco formulation exhibits a pH of about 6.8 to about 8.8 (e.g., about 7.4 to about 8.2). A representative technique for determining the pH of a smokeless tobacco formulation involves dispersing 5 g of that formulation in 100 ml of high performance liquid chromatography water, and measuring the pH of the resulting suspension/solution (e.g., with a pH meter).

The hardness of the smokeless tobacco product of the invention can vary, but is typically at least about 5 kp (kiloponds), more often at least about 8 kp, and most often at least about 10 kp or at least about 12 kp (e.g., a hardness range of about 5 kp to about 20 kp or about 8 kp to about 15 kp). Hardness can be measured using a hardness tester such as a Varian VK 200 or equivalent.

The amount of carbon dioxide that evolves from the effervescence reaction in each product unit can vary, and depends in part on the desired sensory characteristics of the product. The amount of effervescent material can be selected to achieve the desired level of carbon dioxide release. One method for measuring the amount of carbon dioxide released from a product unit (e.g., a single pellet) involves the following steps: (1) pipetting 1 ml of water to a vial; (2) capping the vial; (3) pre-weighing the capped vial using, for example, a Mettler Model AE163 balance or equivalent analytical balance readable to 0.0001 g; (4) reweight capped vial along with a product unit to be tested; (5) add the product unit to the water in the vial and cap the vial loosely (tighten cap until barely tight and then loosen cap slightly); (6) after about thirty minutes, vortex the vials for 3-4 seconds using a vortex mixer such as a Fisher Scientific Touch Mixer Model 232 or equivalent; (8) loosen cap to release trapped gas and then again cap vial loosely; (9) after about one hour, repeat Steps 7 and 8 and reweigh vial; and (10) after about 1.5 hours, repeat Steps 7 and 8 and reweigh vial. The amount of carbon dioxide evolved from the product unit is the difference in weight from Step 4 to Step 10.

In the above test, the intent is to use enough water in the vial to initiate the reaction between acid and base, but not so much that an appreciable amount of carbon dioxide remains dissolved in the water. Vortexing the sample agitates the liquid to overcome supersaturation of the water with carbon dioxide. The vials are loosely capped to allow carbon dioxide to escape without allowing water to evaporate. Carbon dioxide is heavier than air so weights at different time points are taken to make sure that the carbon dioxide has diffused out of the head space of the vial. The last two vial weights should agree within about 1.5 mg.

The amount of evolved carbon dioxide from a product unit of the invention can be expressed as a ratio of weight of carbon dioxide evolved to total product unit weight. In certain embodiments, this ratio can be between about 10 micrograms carbon dioxide per milligram of product to about 120 micrograms carbon dioxide per milligram of product, more typically about 10 mcg carbon dioxide/mg to about 60 mcg carbon dioxide/mg, more often about 10 mcg carbon dioxide/mg to about 30 mcg carbon dioxide/mg. In certain embodiments, the amount of evolved carbon dioxide can be characterized as at least about 10 mcg carbon dioxide/mg of product, or at least about 15 mcg carbon dioxide/mg of product.

The smokeless tobacco product can be packaged within any suitable inner packaging material and/or outer container. See also, for example, the various types of containers for smokeless types of products that are set forth in U.S. Pat. No. 7,014,039 to Henson et al.; U.S. Pat. No. 7,537,110 to Kutsch et al.; U.S. Pat. No. 7,584,843 to Kutsch et al.; D592,956 to Thiellier and D594,154 to Patel et al.; US Pat. Pub. Nos. 2008/0173317 to Robinson et al.; 2009/0014343 to Clark et al.; 2009/0014450 to Bjorkholm; 2009/0250360 to Bellamah et al.; 2009/0266837 to Gelardi et al.; 2009/0223989 to Gelardi; 2009/0230003 to Thiellier; 2010/0084424 to Gelardi; and 2010/0133140 to Bailey et al; and U.S. patent application Ser. No. 29/342,212, filed Aug. 20, 2009, to Bailey et al.; Ser. No. 12/425,180, filed Apr. 16, 2009, to Bailey et al.; Ser. No. 12/685,819, filed Jan. 12, 2010, to Bailey et al.; and Ser. No. 12/814,015, filed Jun. 11, 2010, to Gelardi et al., which are incorporated herein by reference.

EXPERIMENTAL

Aspects of the present invention are more fully illustrated by the following examples, which are set forth to illustrate certain aspects of the present invention and are not to be construed as limiting thereof. Unless otherwise noted, all parts and percentages are on a dry weight basis.

Example 1

A tobacco composition is heat-treated in the presence of lysine according to the process described in U.S. patent application Ser. No. 12/476,621, filed Jun. 2, 2009, to Chen et al. The tobacco composition comprises about 82.7 weight percent particulate tobacco material, about 8.5 weight percent sodium carbonate, about 1.7 weight percent sodium bicarbonate, and about 0.75 weight percent sodium chloride. A granulation mixture is prepared according to Table 1 below, wherein the tobacco composition is the heat-treated tobacco composition described above.

TABLE 1

| Granulation Mix | |
|---|---|
| Dry Ingredients | % w/w |
| Tobacco Composition | 47.0 |
| Sucralose | 1.8 |
| Citric Acid | 2.0 |
| Tartaric Acid | 2.0 |
| Sodium Carbonate | 13.4 |
| VIVAPUR ® 101 (microcrystalline cellulose) | 5.5 |
| Maltodextrin | 11.3 |
| Mannitol | 12.3 |
| Titanium Dioxide | 0.7 |

The dry ingredients of Table 1 are mixed together to form a dry blend using a Littleford Model FM 130D mixer or equivalent. A liquid binder solution is prepared by dispersing PLASDONE® K 29/32 (povidone) into deionized water (10% solids content) using a Waring Commercial Blender Model 34BL22.

The granulation mix is then agglomerated and granulated by addition of the liquid binding solution to the dry blend using a Freund Vector VFC60 fluid bed granulator or equivalent with a target particle size of about 150 microns. The plasdone binder is present in an amount of about 4.0 weight percent in the granulation mixture. The granulated material is then blended with additional components to form the final tablet composition set forth in Table 2.

TABLE 2

| Tablet Composition | |
|---|---|
| Final Blending Formula | % w/w |
| Granulation Mix (from Table 1) | 78.30 |
| Sodium Bicarbonate | 11.00 |
| Citric Acid | 2.50 |
| Tartaric Acid | 2.50 |
| Flavor (Pepperment) | 3.30 |
| Spray dried menthol | 1.10 |
| AEROSIL ® 200 (Silicon Dioxide) | 0.70 |
| Magnesium Stearate | 0.30 |
| SPEZIOL ® (Stearic Acid) | 0.30 |

The components in Table 2 are mixed in a 3-cubic-foot Patterson Kelley Cross Flow Blender using the following procedure: (1) mix about 10-20 percent of the granulation mix with the silicon dioxide for about 10 minutes; (2) add all the other components of Table 2 except the magnesium stearate and stearic acid and mix for about 10 minutes; and (3) add the magnesium stearate and stearic acid and mix for about 10 minutes.

The mixed tablet composition is then pressed in a Fette 1200i tablet press. The final tablet weight is about 300 mg.

A coating composition is prepared using the composition set forth in Table 3.

TABLE 3

| Coating Composition | |
|---|---|
| Coating Formula | % w/w |
| WALOCEL ™ HM 10% solution (hydroxypropylmethylcellulose solution) | 64.15 |
| PlasACRYL ™ (aqueous emulsion of glyceryl monostearate and triethyl citrate) | 1.00 |
| Sucralose | 0.40 |
| Titanium Dioxide | 1.20 |
| Caramel Color (DD Williamson) | 2.00 |
| Menthol | 0.40 |
| NaCl | 0.35 |
| Dry Mint Flavor | 1.20 |
| Deionized Water | 29.30 |

The coating composition is mixed using a Caframo Stirrer Model RZR50 according to the following process: (1) add PlasACRYL™ material, one-half of the deionized water and the sucralose, in the listed order, to the WALOCEL™ solution while mixing; (2) separately mix remaining deionized water with dry flavor and menthol to form solution; and (3) add solution from step (2) to mixture from step (1). The coating composition is applied to the tablets using a pan coater (Thomas Engineering Accela-Cota Model 24-111). The coating brings the coated tablet weight to about 305 mg.

Example 2

A GXR-35 GRANUREX™ Rotor Processor available from Vector Corporation is used to produce dry powder layered effervescent tobacco spheres. This example describes production of tobacco spheres made from 0.805 mm microcrystalline cellulose (MCC) cores to sizes ranging from 1.5 mm to 8 mm. The tobacco spheres are produced using a dry powder tobacco blend and an aqueous binding solution containing povidone (e.g., PVP K30 or PLASDONE® K 29/32).

A tobacco formulation as set forth in Table 4 is prepared by first dispensing all ingredients into a 2-cubic-foot V-Shell Blender and allowed to mix for 10 minutes. The blend is then passed through an Allen Bradley 542 bar mill with a 20 US mesh screen in order to break up any agglomerates. Finally, the blend is charged back into the V-Shell Blender and mixed for an additional 10 minutes.

TABLE 4

| Tobacco Blend Formulation | |
|---|---|
| Ingredients | % w/w |
| Tobacco Blend | 35.00 |
| Mannitol | 24.00 |
| Maltodextrin | 14.65 |
| Sucralose | 1.35 |
| AVICEL ® pH 101 NF (microcrystalline cellulose) | 25.00 |

An effervescent blend having a weight ratio of 1:1.31:1.55 citric acid:sodium bicarbonate:sodium carbonate is diluted with 25% mannitol. The effervescent blend is first dispensed into the V-Shell Blender and allowed to mix for 10 minutes. The blend is then passed through an Allen Bradley 542 bar mill with a 20 US mesh screen in order to break up any agglomerates. Finally, the blend was charged back into the V-Shell Blender and mixed for an additional 10 minutes. The blend is then inductively sealed with desiccants in a Mylar pouch before use.

In an initial run, microcrystalline spheres are used as the core material. A 750 gram batch of CELPHERE™ CP-708 microcrystalline cellulose, having an average particle size of 710-850 μm, is charged into the GXR-35 rotor granulator. The initial run is processed until 3,460 g of tobacco blend has been applied using a 10% (w/w) solution of povidone as the binder. The ratio of povidone (PLASDONE® K 29/32) to tobacco blend for this run is 1:23.2. The rotor granulator is run using the following parameters: powder application rate of 15-38 g/min; solution application rate of 8.8-12.0 g/min; rotor speed of 225-255 rpm; and fluid bed air exhaust temperature of 17.9-19.1° C. The total binding solution applied during this run is 1,486 g and the total run time is 110 minutes. Visual inspection of the material shows that a large amount of tobacco blend has not adhered to the pellets.

The spheres produced in the above run are screened using an 18 mesh US sieve and spheres over the 18 mesh (1 mm) size are charged back to the rotor granulator and coated again. The run is halted after an additional 1,560 grams of tobacco blend is applied. The ratio of povidone to tobacco blend is 1:20.9 for this run. The rotor granulator is run using the following parameters: powder application rate of 15-40 g/min; rotor speed of 250 rpm; and fluid bed air exhaust temperature of 18.2-19.6° C. The total binding solution applied during this run is 745 g and the total run time is 60 minutes.

The spheres produced in the second run are screened using a 10 mesh US sieve and spheres over the 10 mesh (2 mm) size are charged back to the rotor granulator and coated again. The run is halted after an additional 2,200 grams of tobacco blend is applied. The ratio of povidone to tobacco blend is 1:22 for this run. The rotor granulator is run using the following parameters: powder application rate of 15-30 g/min; rotor speed of 250 rpm; and fluid bed air exhaust temperature of 16.6-18.3° C. The total binding solution applied during this run is 1,000 g and the total run time is 85 minutes.

The spheres produced in the third run are screened using a 6 mesh US sieve and an 8 mesh US sieve and spheres over the 8 mesh (2.38 mm) size are charged back to the rotor granulator and coated again. The run is halted after an additional 2,884 grams of tobacco blend is applied. The ratio of povidone to tobacco blend is 1:22.9 for this run. The rotor granulator is run using the following parameters: powder application rate of 15-35 g/min; rotor speed of 250 rpm; and fluid bed air exhaust temperature of 19.4-26.1° C. The total binding solution applied during this run is 1,262 g and the total run time is 100 minutes.

The spheres produced in the fourth run are screened using a 4 mesh US sieve and an 8 mesh US sieve and spheres over the 4 mesh (4.76 mm) size are charged back to the rotor granulator and coated again. The run is halted after an additional 3,115 grams of tobacco blend is applied. The ratio of povidone to tobacco blend is 1:25.2 for this run. The rotor granulator is run using the following parameters: powder application rate of 15-40 g/min; rotor speed of 260 rpm; and fluid bed air exhaust temperature of 19.6-24.7° C. The total binding solution applied during this run is 1,236 g and the total run time is 95 minutes. The resulting size of the spheres is between 8 and 10 mm.

Moisture analysis performed on the final spheres using a loss on drying (LOD) balance reveal a moisture percentage (w/w) of 17.87. Additional drying is performed in an oven for approximately 3 hours. The resulting dried spheres show a hard and visually dry surface, but examination of a material cross section reveals a wet internal core.

The tobacco spheres are then prepared for coating with the effervescent blend to produce tobacco product containing an effervescent material. A batch of spheres from the final run noted above are charged into the rotor granulator and an ethanol based 10% w/w povidone solution (PLASDONE® K 29/32) is prepared for use as the binding solution. An initial coating of povidone is applied to the spheres to prevent residual moisture in the spheres from interacting with the effervescent coating. Thereafter, the spheres are allowed to dry.

For coating the effervescent blend, the rotor granulator is run using the following parameters: powder application rate of 15 g/min; rotor speed of 200 rpm; and fluid bed air exhaust temperature of 20.1-34.5° C. About 593 g of effervescent blend and about 586 g of binder solution are applied to the spheres over 43 minutes before halting the run due to observed poor adhesion of the effervescent layer. However, immersion of the coated spheres in a water bath reveals extensive effervescence due to the coated layer.

In order to increase adhesion of the effervescent couples to the tobacco spheres, 20% (w/w) of the tobacco blend is incorporated into the effervescent blend along with 1% sucralose. The modified blend was first dispensed into a 2-cubic-foot V-Shell Blender and allowed to mix for 10 minutes. The blend is then passed through an Allen Bradley 542 screen granulator with a 20 US mesh screen in order to break up any agglomerates. Finally, the blend is charged back into the V-Shell Blender and mixed for an additional 10 minutes. The blend is then inductively sealed with desiccants in a Mylar pouch before use.

A batch of 2.38 mm spheres are charged into the GXR-35 rotor granulator and dried before processing. After drying, 451 grams of 10% (w/w) PLASDONE® K29/32 EtOH based solution is sprayed onto the spheres to provide a barrier coat and then dried to a measured surface moisture content of 5.9%. The tobacco blend containing the effervescent material is then applied using the same 10% (w/w) PLASDONE® K29/32 EtOH based system as a binding solution. The run is halted after 765 grams of modified effervescent blend. The ratio of povidone binder to effervescent blend is 1:6.03 for this run. For coating the modified effervescent blend, the rotor granulator is run using the following parameters: powder application rate of 15-25 g/min; rotor speed of 200-250 rpm; and fluid bed air exhaust temperature of 17.8-35.6° C. The total binding solution applied during this run is 817 g and the total run time is 40 minutes. These spheres are screened through an 18 US sieve screen (1 mm). Immersion of the pellets in a water bath did reveal extensive effervescence due to the coated layer.

In order to assess the feasibility of using an ethanol based binding solution to coat tobacco blend onto pellet cores and to assess whether tobacco blend could be coated onto effervescent coated pellets, 1,021 grams of spheres coated with the modified effervescent material are charged back into the GXR-35 rotor granulator. The same 10% (w/w) ethanol based povidone solution is used as binding solution. After 2,066 grams of tobacco blend is applied to the spheres, the run was halted. The ratio of povidone binder to tobacco blend was 1:9.8 for this run. For coating the modified effervescent blend, the rotor granulator is run using the following parameters: powder application rate of 15-35 g/min; rotor speed of 250 rpm; and fluid bed air exhaust temperature of 18.1-21.2° C. The total binding solution applied during this run is 2,095 g and the total run time is 75 minutes. The effervescent layer is observed to be completely coated over with the tobacco blend coating.

Due to the large residual moisture left in the tobacco pellets while using an aqueous based binding solution, an alternative binding solution consisting of 10% (w/w) PLASDONE® K29/32, 45% (w/w) water, and 45% (w/w) ethanol is investigated. Previously-formed tobacco coated spheres having a size of 4.76 mm are charged into the GXR-35 rotor granulator. After approximately two hours of rotor granulation, 2,944 g of tobacco blend is applied to the tobacco spheres. The ratio of povidone binder to tobacco blend was 1:16.8 for this run. The rotor granulator is run using the following parameters: powder application rate of 15-35 g/min; rotor speed of 250 rpm; and fluid bed air exhaust temperature of 15.2-17.7° C. The total binding solution applied during this run is 1,747 g. These spheres are then allowed to dry for 3 hours in the rotor granulator. The resulting moisture content was measured at below 6% by LOD balance.

Many modifications and other embodiments of the invention will come to mind to one skilled in the art to which this invention pertains having the benefit of the teachings presented in the foregoing description. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

We claim:

1. A smokeless tobacco composition containing an effervescent material and adapted for oral use, comprising:

(i) a tobacco material, at least a portion of which is in a particulate form or in the form of a tobacco extract; and (ii) an effervescent material comprising an acid component and a base component, wherein the acid component comprises a combination of a tricarboxylic acid and a dicarboxylic acid in a weight ratio of about 2:1 to about 1:2, and wherein the amount of effervescent material is at least about 10 dry weight percent, the amount of acid component is about 3 to about 20 dry weight percent, and the base component comprises a carbonate material present in an amount of about 3 to about 20 dry weight percent and a bicarbonate material present in an amount of about 3 to about 20 dry weight percent, all percentages based on the total dry weight of the composition, and the base component comprising a stoichiometric amount of the bicarbonate material with respect to the acid component such that the bicarbonate material is sufficient to react with all of the acid component to form carbon dioxide;

and further wherein the smokeless tobacco composition is in the form of a compressed or extruded product having a predetermined shape that disintegrates in the oral cavity during use.

2. The composition of claim 1, wherein the tricarboxylic acid is citric acid.

3. The composition of claim 1, wherein the dicarboxylic acid is tartaric acid.

4. The composition of claim 1, further comprising one or more additives selected from the group consisting of salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof.

5. The composition of claim 1, wherein the predetermined shape is a pellet, rod, or film.

6. The composition of claim 1, wherein the composition is a multi-layer product comprising at least one effervescent layer and at least one non-effervescent layer.

7. The composition of claim 1, comprising:

at least about 20 dry weight percent of tobacco material, based on the total weight of the composition;

at least about 10 dry weight percent of effervescent material;

at least about 0.1 dry weight percent of at least one sweetener;

at least about 10 dry weight percent of at least one filler;

at least about 0.5 dry weight percent of at least one binder;

at least about 0.5 dry weight percent of at least one flavorant; and at least about 0.5 dry weight percent of at least one flow aid.

8. The composition of claim 7, wherein the effervescent material comprises a combination of citric acid and tartaric acid.

9. The composition of claim 7, wherein the filler comprises at least one of microcrystalline cellulose, mannitol, and maltodextrin.

10. The composition of claim 1, further comprising an outer coating.

11. The composition of claim 10, wherein the outer coating comprises a cellulosic polymer and a plasticizer.

12. The composition of claim 11, wherein the cellulosic polymer is selected from the group consisting of methylcellulose, hydroxypropyl cellulose, hydroxypropyl methylcellulose, hydroxyethyl cellulose, and carboxy methylcellulose.

13. The composition of claim 11, wherein the plasticizer is selected from the group consisting of glyceryl mono stearate and triethyl citrate.

14. The composition of claim 10, wherein the outer coating comprises a film-forming polymer solution in an amount up to about 75 weight percent, a plasticizer in an amount up to about 5 weight percent, a sweetener in an amount up to about 5 weight percent, and one or more colorants in an amount up to about 10 weight percent, based on total weight of the coating formulation.

15. A smokeless tobacco container containing a plurality of units of a smokeless tobacco product comprising the composition according to claim 1.

16. The composition of claim 1, wherein the tobacco material is present in an amount of about 10 to about 80 dry weight percent, based on the total dry weight of the composition.

17. The composition of claim 1, wherein the composition is in the form of a compressed pellet having a hardness of at least about 5 kp.

18. The composition of claim 17, wherein the hardness is at least about 10 kp.

19. The composition of claim 1, wherein the amount of effervescent material is at least about 15 dry weight percent, based on the total dry weight of the composition.

20. A method of making a smokeless tobacco composition containing the effervescent material according to claim 1, comprising:

(i) preparing a granulation mixture comprising the tobacco material, a first portion of the acid component, and at least one additive selected from the group consisting of salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof;

(ii) granulating the granulation mixture by mixing the granulation mixture with a binding solution to form a granular material;

(iii) blending the granular material with the base component, a second portion of the acid component component, and at least one additive selected from the group consisting of salts, flavorants, sweeteners, fillers, binders, buffering agents, colorants, humectants, oral care additives, preservatives, syrups, disintegration aids, antioxidants, additives derived from an herbal or botanical source, flow aids, compressibility aids, and combinations thereof to form the smokeless tobacco composition comprising the effervescent material; and (iv) forming the smokeless tobacco composition into the predetermined shape.

21. The method of claim 20, wherein the tricarboxylic acid is citric acid.

22. The method of claim 20, wherein the dicarboxylic acid is tartaric acid.

23. The method of claim 20, wherein the first portion of acid component comprises about 25 to about 75 dry weight percent of the total acid component within the smokeless tobacco composition.

24. The method of claim 20, wherein the granulation mixture further comprises at least one base component.

25. The method of claim 20, wherein said forming step comprises compressing or extruding the smokeless tobacco composition into the predetermined shape.

26. The method of claim 20, further comprising the step of applying an outer coating to the smokeless tobacco composition after said forming step.

27. The method of claim 20, wherein the granulation mixture comprises one or more of additives selected from the group consisting of fillers, binders, sweeteners, colorants, and compressibility aids.

28. The method of claim 20, wherein the additives used in said blending step comprise one or more additives selected from the group consisting of flavorants and flow aids.

* * * * *